US008287747B2

(12) United States Patent
Kishimoto et al.

(10) Patent No.: US 8,287,747 B2
(45) Date of Patent: Oct. 16, 2012

(54) METHOD OF PROCESSING SILICON SUBSTRATE AND METHOD OF MANUFACTURING SUBSTRATE FOR LIQUID DISCHARGE HEAD

(75) Inventors: Keisuke Kishimoto, Yokohama (JP); Taichi Yonemoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 12/784,144

(22) Filed: May 20, 2010

(65) Prior Publication Data

US 2010/0323526 A1 Dec. 23, 2010

(30) Foreign Application Priority Data

Jun. 17, 2009 (JP) ..... 2009-144152

(51) Int. Cl.
*H01B 13/00* (2006.01)

(52) U.S. Cl. ..... 216/17; 216/27; 216/83; 216/99; 438/753

(58) Field of Classification Search ..... 216/27, 216/91, 97, 99, 17, 41; 438/745, 750, 753
See application file for complete search history.

(56) References Cited

U.S. PATENT DOCUMENTS

| | | | | |
|---|---|---|---|---|
| 7,238,293 | B2 | 7/2007 | Donaldson et al. | |
| 7,625,776 | B2 * | 12/2009 | Wells et al. | 438/68 |
| 2007/0207414 | A1 | 9/2007 | Murayama et al. | |
| 2007/0212891 | A1 * | 9/2007 | Yamamuro et al. | 438/733 |
| 2008/0153204 | A1 * | 6/2008 | Jackson et al. | 438/109 |
| 2009/0065429 | A9 * | 3/2009 | Dickensheets et al. | 210/490 |
| 2009/0065472 | A1 | 3/2009 | Asai et al. | |
| 2009/0065476 | A1 | 3/2009 | Komiyama et al. | |
| 2009/0065481 | A1 | 3/2009 | Kishimoto et al. | |
| 2009/0065482 | A1 | 3/2009 | Komiyama et al. | |
| 2009/0149009 | A1 * | 6/2009 | Tischler | 438/585 |

FOREIGN PATENT DOCUMENTS

| | | |
|---|---|---|
| JP | 2004-148824 A | 5/2004 |
| JP | 2007-237515 A | 9/2007 |

* cited by examiner

*Primary Examiner* — Lan Vinh
(74) *Attorney, Agent, or Firm* — Fitzpatrick, Cella, Harper & Scinto

(57) ABSTRACT

A method of processing a substrate includes the steps of providing a silicon substrate that has an etching mask layer with an opening portion at a first surface thereof and has plane orientation of {100} with the surface of the silicon being exposed from the opening portion; preparing a recessed portion that faces from the first surface to a second surface, opposite to the first surface, in the opening portion of the silicon substrate; and forming a penetration port that passes through the first surface and the second surface of the silicon substrate by executing crystalline anisotropic etching in the silicon substrate using an etching liquid in which an etching rate for etching a (100) surface of silicon is higher than an etching rate for etching a (110) surface of silicon, from the recessed portion of the silicon substrate toward the second surface.

6 Claims, 3 Drawing Sheets

METHOD OF PROCESSING SILICON SUBSTRATE AND METHOD OF MANUFACTURING SUBSTRATE FOR LIQUID DISCHARGE HEAD

BACKGROUND OF THE INVENTION

1. Field of the Invention

The present invention relates to a method of processing a silicon substrate so as to form a penetration port in the silicon substrate and a method of manufacturing a substrate for a liquid discharge head that discharges a liquid such as an ink to a material to be recorded such as a recording paper.

2. Description of the Related Art

A method of manufacturing an ink jet recording head which is a typical example of the liquid discharge head is described in the following patent documents.

Japanese Patent Application Laid-open No. 2004-148824 discloses a method of manufacturing an ink jet recording head by etching silicon after having been subjected to a trench processing by laser. In this method, a large amount of inscription of a trench with a laser processing is required. However, there is a problem in that time required for the laser processing is extended along with an increase in amount of inscription by the laser processing, which reduces the manufacturing efficiency.

Japanese Patent Application Laid-open No. 2007-237515 discloses a method of manufacturing a substrate for a liquid discharge head in which the substrate is formed with a non-penetration port by laser light and then is subjected to anisotropic etching. According to this manufacturing method, a processing section with a middle portion expanded in a transverse direction is formed. However, even in this method, the section of the ink supply port is also formed in the expanded shape, and thus there is a limitation in the reduction of the width size of the liquid discharge head.

As described above, in the process for forming the ink supply port, in order to reduce the width size of the ink jet head, there is a demand that the passage width of the ink supply port of the silicon substrate is narrowly formed and the ink supply port is effectively formed.

Moreover, in general, the ink supply port is formed by forming a mask on an opposite surface of the silicon substrate and executing the anisotropic etching from the opposite surface. However, in this process, the etching time for forming the ink supply port is long and the passage width of the opposite surface of the silicon substrate is extended in the transverse direction, which makes it difficult to reduce the ink jet head.

Furthermore, in order to reduce the etching time, as described in Japanese Patent Application Laid-open No. 2007-237515, a method whereby a part of the silicon substrate is removed to shorten the anisotropic etching time is effective. The anisotropic etching amount can be reduced to the extent of the depth that a part of the silicon substrate is eliminated, so it is possible to suppress the extension of the ink supply port in the transverse direction to more effectively achieve the reduction in size of the ink jet head and the reduction of the etching time. However, if the etching rates of the respective plane orientations of the anisotropic etching are not controlled, the width of the ink supply port is widened due to the time of the anisotropic etching, and thus, there is a problem in that the elimination amount of the silicon is large, which lowers the production efficiency.

SUMMARY OF THE INVENTION

Thus, an object of the present invention is to provide a method of processing a silicon substrate that can form a penetration port with a small width in the silicon substrate so as to form the penetration port effectively and a method of manufacturing a substrate for a liquid discharge head.

In order to achieve the object, a method of processing a substrate of the present invention includes the following steps; providing a silicon substrate that has an etching mask layer with an opening portion at a first surface thereof and has plane orientation of {100} with the surface of the silicon being exposed from the opening portion, preparing a recessed portion that faces from the first surface to a second surface, which is an opposite surface of the first surface, in the opening portion of the silicon substrate, and forming a penetration port that passes through the first surface and the second surface of the silicon substrate by executing crystalline anisotropic etching in the silicon substrate using an etching liquid in which an etching rate for etching a (100) surface of the silicon is higher than an etching rate for etching a (110) surface of the silicon from the recessed portion of the silicon substrate toward the second surface.

Moreover, in order to achieve the above-mentioned object, there is a method of manufacturing the substrate for the liquid discharge head of the present invention which has the following constitution.

A method of manufacturing a substrate for a liquid discharge head which is equipped with an energy generating element for generating energy used for discharging the liquid and a supply port for supplying the energy generating element with liquid has the following steps: providing a silicon substrate that has the energy generating element provided in a second surface, has an etching mask layer with an opening portion at a first surface thereof which is an opposite surface of the second surface, and has plane orientation of {100} with the surface of the silicon being exposed from the opening portion, preparing a recessed portion that faces from the first surface to a second surface, which is an opposite surface of the first surface, in the opening portion of the silicon substrate, and forming a penetration port that passes through the first surface and the second surface of the silicon substrate by executing crystalline anisotropic etching in the silicon substrate using an etching liquid in which an etching rate for etching a (100) surface of the silicon is higher than an etching rate for etching a (110) surface of the silicon from the recessed portion of the silicon substrate toward the second surface.

According to the present invention, the penetration port can be formed while suppressing the expansion of the transverse width (in a plane direction), an effective method of processing the silicon substrate and a method of manufacturing the substrate for the liquid discharge head can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the present invention, an etching mask layer with an opening portion is formed on an opposite surface of a silicon substrate. Non-penetration port (also referred to as a leading hole) is formed on the opposite surface of the silicon substrate via the opening portion. The non-penetration port can be formed, for example, by exposure of a laser light.

Furthermore, after a plurality of leading holes is formed, anisotropic etching is executed from the opposite surface of the silicon substrate, by using an etching liquid in which an etching rate of a (100) surface is higher than that of a (110) surface.

As the etching liquid, silicon anisotropic etching liquid such as potassium hydroxide and tetramethyl ammonium hydroxide (TMAH) may be used. Furthermore, in regard to the etching liquid, liquids which have additives added can be used. As the additives, etching liquids which have had added an alcohol-based surfactant, a non ion-based surfactant, a reducing agent or the like can be used.

Figure 1:
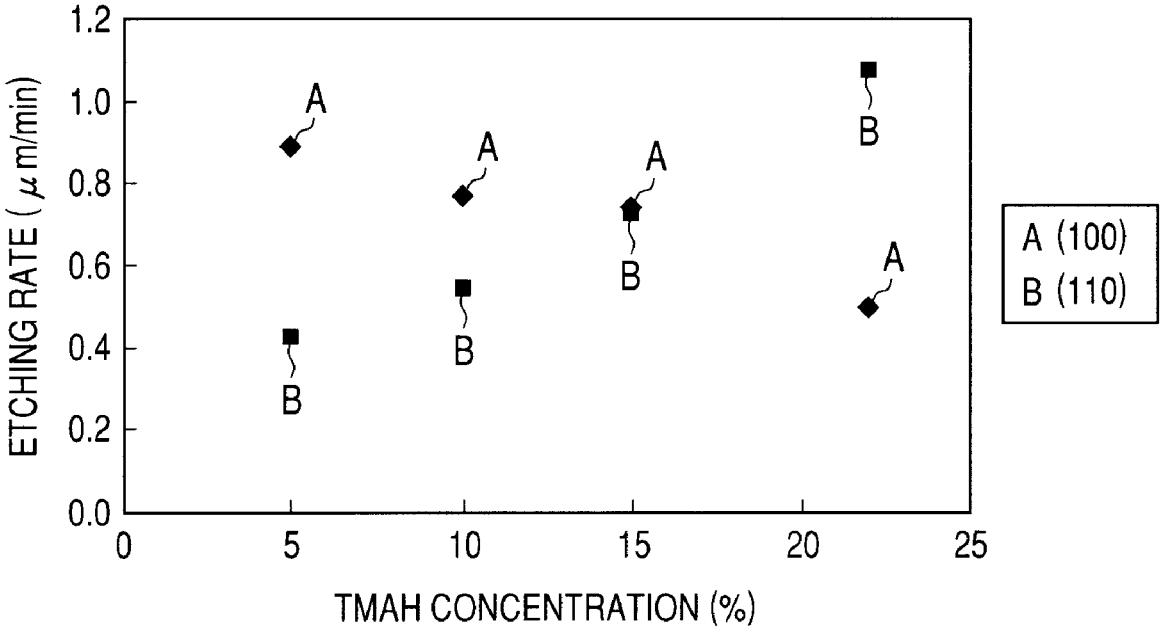
FIG. 1 illustrates a relationship between a TMAH concentration and an etching rate of silicon.

FIG. 1 is a graph that illustrates a relationship between concentration of TMAH in the TMAH aqueous solution and an etching rate of a silicon surface. The vertical axis of the graph indicates the etching rate of the single crystal silicon. The horizontal axis thereof indicates TMAH concentration (wt %) in an aqueous solution. Each point A is an etching rate that progresses in a direction perpendicular to the (100) surface of the single crystal silicon. On the other hand, each point B is an etching rate that progresses in a direction perpendicular to the (110) surface of the single crystal silicon. When the TMAH concentration is equal to or less than 15 wt %, it can be seen that the etching rate of the (100) surface is higher than that of the (110) surface.

Preferred embodiments of the present invention will now be described in detail with reference to the accompanying drawings.

In addition, the method of processing the silicon substrate according to the present invention is very suitable for forming a penetration port such as an ink supply port (a liquid supply port) in the silicon substrate, in the manufacturing process of a structure including the silicon substrate, in particular, a liquid discharge head such as an ink jet head. In the description below, for example, a substrate for an ink jet recording head which is an example of the substrate for the liquid discharge head will be described as an applied example of the present invention, but the application range of the present invention is not limited thereto. The liquid discharge head can also be applied to a method for manufacturing a substrate for a liquid discharge head used for a biochip production or an electronic circuit printing, in addition to the substrate for the ink jet head. As the liquid discharge head, for example, a head for manufacturing a color filter may be included in addition to the ink jet recording head.

(First Embodiment)

Figure 2A:
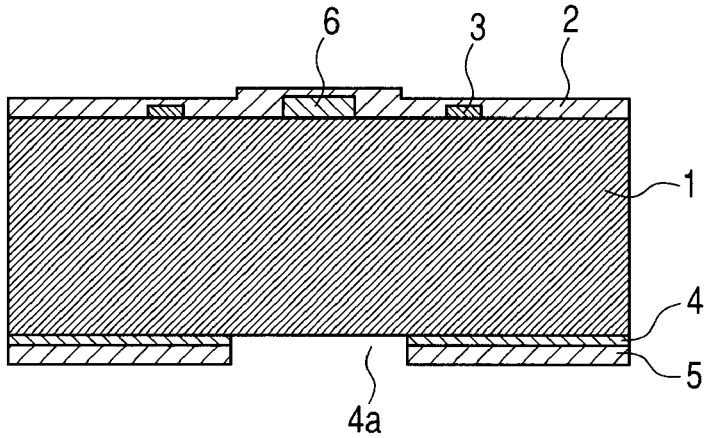
FIGS. 2A, 2B, 2C and 2D are sectional views for describing an embodiment of the present invention.

In FIG. 2A, on a front (second) surface ((100) surface) of a silicon substrate 1 with plane orientation {100}, an electric heat conversion element 3 constituting a heater is disposed. The heater functions as a discharge energy generating element for discharging ink. The ink is an example of a liquid and the electrically produced heat is an example of the generating energy for the present invention. The electric heat conversion element 3 can be formed by the use of TaN, for example. Moreover, a sacrificial layer 6 is formed on the front surface of the silicon substrate 1. In addition, on the front surface of the silicon substrate 1 and the sacrificial layer 6, an etching stop layer (referred to as a passivation layer) 2 with etch resistant property is formed as a protective layer of the heat conversion element 3.

In addition, a control signal input electrode (not illustrated) for driving the element is electrically connected to the electric heat conversion element 3. Furthermore, the thickness of the silicon substrate 1 is formed to be about 725 μm. In the present embodiment, the description will be given to just the silicon substrate 1 constituting a part of the substrate for the ink jet head, but in practice, the same processing is executed with a wafer as a unit.

Furthermore, a coated resin layer or the like for constituting an ink flow path may be formed on the silicon substrate.

The sacrificial layer 6 is effective when it is desired that a forming area of the ink supply port is precisely defined but is not essential for the present invention. The etching stop layer 2 is formed of a material having a resistance to the materials used in the anisotropic etching. The etching stop layer 2 serves as a partition or the like when elements or structures (members that form the ink flow path or the like) are formed on the surface of the silicon substrate. The sacrificial layer 6 and the etching stop layer 2 may be formed on the silicon substrate at the step prior to execution of the anisotropic etching in case of single use or parallel use. The forming time or order at the step prior to the anisotropic etching is arbitrary and can be formed by any known method.

As illustrated in FIG. 2A, on a reverse or opposite (first) surface of the silicon substrate 1, an etching mask layer 5 with an opening portion 4*a* on a $SiO_2$ layer 4 is formed and the opening portion becomes a start area of the anisotropic etching. The etching mask can be formed, for example, by the use of polyamide resin.

Figure 2B:
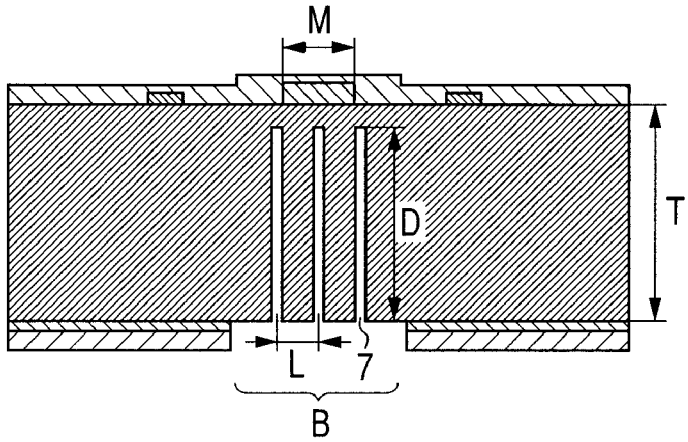

Next, as illustrated in FIG. 2B, by exposing the laser light from the opposite surface of the silicon substrate 1, leading holes 7 as a plurality of recessed portions, which do not penetrate up to the front surface of the silicon substrate 1 are formed from the opposite surface of the silicon substrate 1 toward the front surface thereof. As a method of forming the leading holes 7, laser light having, for example, the wave (THG: wavelength 355 nm) which is three times YAG laser can be used. Furthermore, output and frequency of the laser light are set to be an appropriate value.

Figure 4:
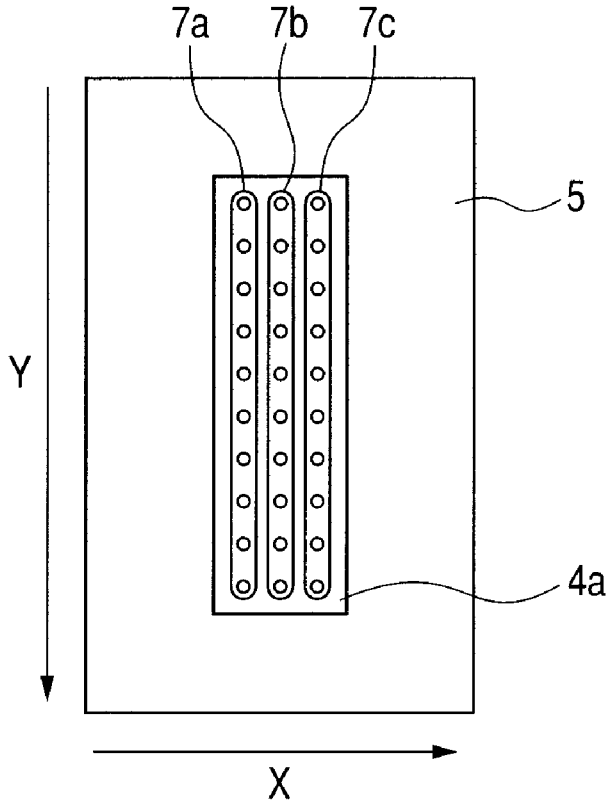
FIG. 4 is a diagram illustrating a state of an opposite surface of a silicon substrate of the state of FIG. 2B of the silicon substrate.

FIG. 4 is a diagram that illustrates the opposite surface state of the silicon substrate 1 in the state of the silicon substrate 1 in FIG. 2B. The leading holes 7 are installed such that they are arranged in a row in a passage 4*a* along a longitudinal direction Y of the passage 4*a* to form a row 7*a*. The same rows 7*b* and 7*c* are disposed along a transverse direction X of the passage 4*a*. In addition, FIGS. 2A to 2D are sectional views that illustrate the respective process states at a position where the silicon substrate 1 is cut vertically to the silicon substrate 1 along the X direction in FIG. 4.

It is desirable that the diameters of the leading holes 7 be in the range of ϕ5 to 100 μm. By making the diameters of the leading holes equal to or larger than ϕ5 μm, the etching liquid easily enters the leading holes during anisotropic etching of the succeeding process. Furthermore, by making the diameters of the leading holes equal to or less than ϕ100 μm, the leading holes can be formed for a relatively long time.

Moreover, it is desirable that the leading holes be formed up to the depth from equal to or larger than 15 μm to 125 μm from the surface which is opposite to the surface to be laser processed by ablation of the laser light.

When the silicon substrate 1 with thickness of 725 μm is used, it is desirable that the depths of the leading holes 7 be from 600 to 710 μm. By making the depths equal to or larger than 600 μm, the time of anisotropic etching can be shortened and the width of the ink supply port can be made smaller.

Moreover, by making the depths equal to or less than 710 μm, there is hardly any transfer of heat such as from the laser to the flow path forming member formed on the front surface of the substrate, whereby problems such as deformation can be suppressed.

In the process for forming the leading holes 7, when it is assumed that the size of the front surface passage of an area which is expected to form the ink supply port in the transverse direction is M, the thickness of the substrate is T, the distance between the centers of the contiguous non penetration ports in the transverse direction is L, the depth of the non penetration port is D, and the number of rows of the non penetration port in the transverse direction is B, it is desirable that the leading hole be formed within the range where the relationship of the following equation is met.

$T-(L\times(B-1)-M/2)\times\tan 54.7° \geqq D \geqq T-L\times(B-1)\times\tan 54.7°$ (herein, B is an integer equal to or larger than 2) the respective units of T, L and M are μm.

When the D is deeper than $T-(L\times(B-1)-M/2)\times\tan 54.7°$, there is a possibility that the size of the front surface passage is opened outside of the M. On the other hand, when the depths D of all the leading holes 7 are shallower than $T-(L\times(B-1)\times\tan 54.7°$, the size of the passage of the mask layer 5 is made larger to a degree that the etching reaches the front surface.

Furthermore, the leading holes 7 can be formed so that the pitch distance thereof is 60 μm with respect to the transverse direction and the longitudinal direction of the silicon substrate 1. Moreover, it is desirable that the leading holes 7 be formed to be equal to or larger than three rows at the pitch distance from equal to or larger than 25 μm to 115 μm with respect to the transverse direction (the transverse direction of the passage 4*b*) of the silicon substrate 1. Similarly, it is desirable that the leading holes 7 be formed to make a plurality of rows at the pitch distance from 25 μm to 115 μm also with respect to the longitudinal direction (the transverse direction of the passage 4*b*) of the silicon substrate 1. By making the pitch distance the above-mentioned range, it can be made so that it is difficult for the ink supply ports to be connected with each other. Moreover, the object processing depth of the leading hole is easily made to be a desired depth, and the extended formations of the ink supply ports can be prevented.

Furthermore, it is desirable that the leading holes 7 be formed so as to symmetrically make three or more rows with respect to the center line of the area that forms the penetration port in the longitudinal direction. In addition, when the numbers of the rows are the odd number, the center row may be formed so as to be disposed on the center line.

The laser light may be of any type which has the wavelength capable of processing the hole with respect to the silicon as a material for forming the silicon substrate 1, and the laser light is not limited to a laser light used for processing the leading holes 7. For example, even with the laser light with the wave twice (SHG: wavelength 532 nm) that of the YAG laser, such laser light has relatively higher absorptive with respect to the silicon similar to the THG, so the leading holes may be formed by using such laser light. Furthermore, the leading holes may be formed by ablation of the laser light, a so-called laser ablation method.

Furthermore, after $SiO_2$ layer is removed from the opening portion of the etching mask layer 5 formed on the opposite surface of the silicon substrate 1 and Si surface becoming the start surface of the anisotropic etching in the silicon substrate 1 is exposed, the leading holes may be formed.

Figure 2C:
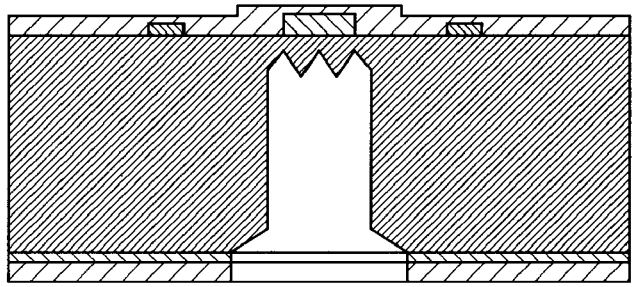

Next, as illustrated in FIG. 2C, the crystalline anisotropic etching is executed from the opposite surface of the silicon substrate by using the etching liquid in which the etching rate of the (100) surface is higher than that of the (110) surface. For example, TMAH (tetramethyl ammonium hydroxide) aqueous solution equal to or larger than 5 w % and equal to or less than 15 wt % may be used as the etching liquid. This indicates the percentage of the weight of TMAH (tetramethyl ammonium hydroxide) out of the weight of the aqueous solutions. When the concentration of TMAH in TMAH aqueous solution is higher than 15 wt %, the etching rate of the (110) surface is higher than that of the (100) surface, and thus the width of the ink supply port (the maximum width in the horizontal direction) increases. On the other hand, when changes in concentration of TMAH in the etching liquid due to the repeated use of etching liquid is considered, it is desirable that the concentration of TMAH in the aqueous solution be equal to or larger than 5 wt %. Furthermore, in this range, TMAH aqueous solution of 6 to 14 wt % is more desirable.

As illustrated in FIG. 2C, in this anisotropic etching, the etching starts from all the wall surfaces of the inner part of a plurality of leading holes 7. In addition, the etching progresses along the (100) surface and the (110) surface with a higher etching rate while forming the (111) surface with a lower etching rate. The etching liquid enters into the plurality of leading holes 7 and connects the leading holes 7 with each other.

After the leading holes 7 are connected with each other, the etching progresses to the front surface side of the substrate.

Figure 2D:
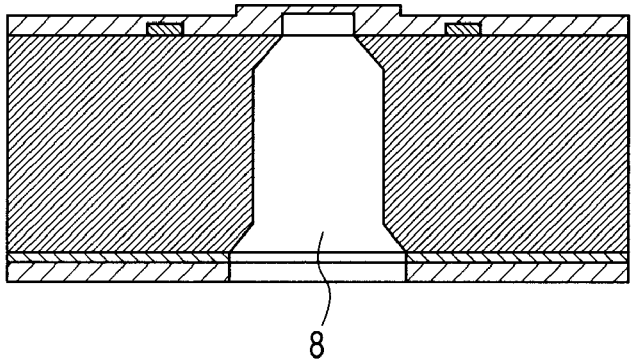

Next, as illustrated in FIG. 2D, the anisotropic etching is executed until an ink supply port (penetration port) 8, which penetrates up to the front surface of the silicon surface 1, is formed. In addition, when the sacrificial layer 6 is formed as an agent which is dissolved in the silicon etching liquid such as aluminum, after the area to be etched reaches the sacrificial layer, the sacrificial layer 6 is dissolved and is removed.

Furthermore, although not illustrated, by removing a portion of the etching stop layer 2, which is formed in the place corresponding to the passage of the ink supply port 8 in the front surface of the silicon substrate 1, with the dry etching, the ink supply port 8 can be opened to the front surface side of the silicon substrate 1.

FIRST EXAMPLE

As illustrated in FIG. 2A, polyether amide resin was overlaid on the $SiO_2$ layer 4 of the opposite surface of the silicon substrate 1 to form the etching mask layer 5 with an opening portion. The silicon substrate with thickness of 725 μm was used. The $SiO_2$ layer 4 was removed from the opening portion.

Next, as illustrated in FIG. 2B, the leading holes 7 were formed by the laser processing in the opening portion of the etching mask layer 5. By setting the depth of the laser processing to be 650 μm and the pitch distance to be 60 μm in the longitudinal and transverse directions, three rows of leading holes were formed in the transverse direction.

Next, as illustrated in FIG. 2C, the crystalline anisotropic etching was executed from the opposite surface of the silicon substrate using TMAH 10 wt %.

In the case of TMAH 10 wt %, the etching rate of the (100) surface is 1.124 μm/min. On the other hand, the etching rate of the (110) surface is 0.789 μm/min. Thus, the etching rate of the (100) surface is higher.

The (111) surface is formed from the front ends of the leading holes 7 situated at the outer periphery sides in the plurality of leading holes 7. At that time, by using the etching liquid in which the etching rate of the (100) surface is higher than that of the (110) surface, the time during which the leading holes are connected with each other is reduced. After the leading holes are connected with each other, the etching progresses in the depth direction (FIG. 2C).

Next, as illustrated in FIG. 2D, the anisotropic etching was executed until the ink supply port 8, which penetrates up to the front surface of the silicon substrate 1, was formed. The width of the passage of the ink supply port was formed to be 0.45 mm.

FIRST COMPARISON EXAMPLE

Figure 3:
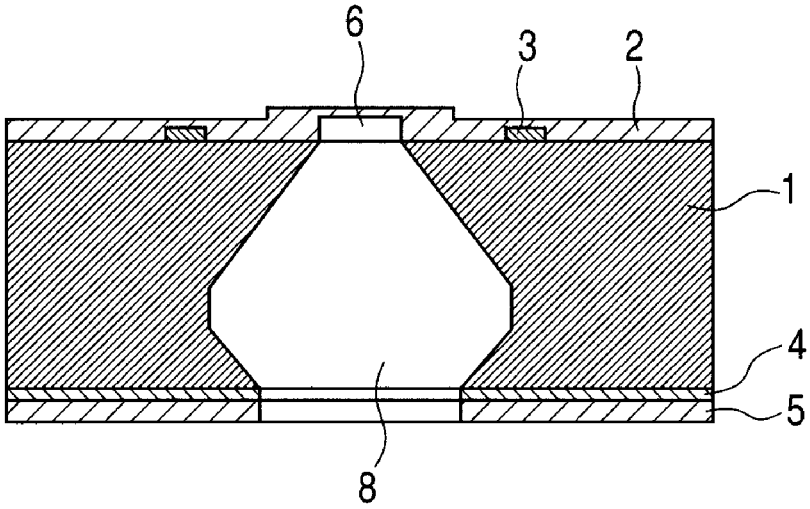
FIG. 3 is a sectional view for describing a comparison example.

In the present comparison example, the process up to the formation of the leading holes 7 was executed similar to the first embodiment and the anisotropic etching was executed using TMAH 22 wt %. In the case of TMAH 22 wt % used in the related art, as illustrated in FIG. 3, the ink supply port to be formed has the sectional shape with the center portion thereof extended in the transverse direction. The etching rate of the (100) surface of the aqueous solution of TMAH 22 wt % is 0.631 μm/min. On the other hand, the etching rate of the (110) surface of the aqueous solution of TMAH 22 wt % is 0.975 μm/min. Thus, the etching rate of the (110) surface is higher. As a result, the transverse extension in the etching increases. The width (inner maximum width) of the ink supply port was formed to be 0.63 mm.

With the above-mentioned embodiment, the etching time of the crystalline anisotropic etching, which takes four hours in the comparison example according to the related art, could be reduced to 3.5 hours. Furthermore, in the comparison example by the concentration of the related art, the width of the passage of the ink supply port was 0.63 mm. However, in the embodiment according to the present invention, it was implied that the width of the passage of the ink supply port can be formed to be 0.45 mm, whereby compaction of the ink jet head can be made.

Thus, according to the present invention, when the penetration port is formed, the etching time of the anisotropic etching of the silicon substrate 1 can be reduced. Furthermore, according to the present invention, the passage of the ink supply port 8 of the silicon substrate 1 can be formed smaller, and the ink supply port can be effectively formed. Thus, according to the present embodiment, the processing speed for forming the penetration port in the silicon substrate can be improved, whereby, for example, a reduction in manufacturing costs of the substrate for the ink jet head or the like can be promoted.

In addition, in the above-mentioned present embodiment, the description has been given for the processing example that forms the ink supply port only in the silicon substrate 1. However, when manufacturing the ink jet head, it is desirable that the process, which forms the ink flow path forming member on the front surface of the silicon substrate 1, be performed before the forming process of the ink supply port performed in the present embodiment. In the case of this configuration, the ink flow path forming member having the discharge port for discharging the ink as the liquid and the ink flow path as the liquid flow path communicating with the discharge port are formed on the front surface of the silicon substrate 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-144152, filed on Jun. 17, 2009, which is hereby incorporated by reference herein in its entirety.

What is claimed is:

1. A method of processing a substrate comprising the steps of:

providing a silicon substrate that has an etching mask layer with an opening portion at a first surface thereof and has a plane orientation of {100} with the surface of the silicon being exposed from the opening portion;

preparing a recessed portion from the first surface to a second surface, which is an opposite surface of the first surface, in the opening portion of the silicon substrate; and forming a penetration port that passes through the first surface and the second surface of the silicon substrate by executing crystalline anisotropic etching in the silicon substrate using an aqueous solution containing tetramethyl ammonium hydroxide at a ratio equal to or greater than 6 wt % and equal to or less than 14 wt %, from the recessed portion of the silicon substrate toward the second surface.

2. The method of processing the substrate according to claim 1, wherein the recessed portion is formed in rows along a longitudinal direction of the opening portion and three or more rows are arranged in a direction of the opening portion transverse to the longitudinal direction.

3. The method of processing the substrate according to claim 1, wherein the recessed portion is formed by ablation processing the silicon substrate with laser light.

4. A method of manufacturing a substrate for a liquid discharge head which is equipped with an energy generating element for generating energy used for discharging liquid and a supply port for supplying the energy generating element with liquid, comprising the steps of:

providing a silicon substrate that has the energy generating element positioned at a second surface, has an etching mask layer with an opening portion at a first surface opposite to the second surface, and has plane orientation of {100} with the surface of the silicon being exposed from the opening portion;

preparing a recessed portion from the first surface to the second surface in the opening portion of the silicon substrate; and forming a supply port that passes through the first surface and the second surface of the silicon substrate by executing crystalline anisotropic etching in the silicon substrate using an aqueous solution containing tetramethyl ammonium hydroxide at a ratio equal to or greater than 6 wt % and equal to or less than 14 wt %, from the recessed portion of the silicon substrate toward the second surface.

5. The method of manufacturing the substrate for the liquid discharge head according to claim 4, wherein the recessed portion is formed in rows along a longitudinal direction of the opening portion and three rows are arranged in a direction of the opening portion transverse to the longitudinal direction.

6. The method of manufacturing the substrate for the liquid discharge head according to claim 4, wherein the recessed portion is formed by ablation processing the silicon substrate with laser light.

* * * * *